US011574610B2

(12) United States Patent
Huang et al.

(10) Patent No.: US 11,574,610 B2
(45) Date of Patent: Feb. 7, 2023

(54) SIGNAL PROCESSING METHOD OF TRANSPARENT DISPLAY

(71) Applicant: Innolux Corporation, Miao-Li County (TW)

(72) Inventors: Yu-Chia Huang, Miao-Li County (TW); Kuan-Feng Lee, Miao-Li County (TW); Tsung-Han Tsai, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/739,181

(22) Filed: May 9, 2022

(65) Prior Publication Data

US 2022/0262325 A1 Aug. 18, 2022

Related U.S. Application Data

(63) Continuation of application No. 17/151,630, filed on Jan. 18, 2021, now abandoned.

(30) Foreign Application Priority Data

Feb. 3, 2020 (CN) ..... 202010078972.8

(51) Int. Cl.

| | |
|---|---|
| ***G09G 5/00*** | (2006.01) |
| ***G09G 5/02*** | (2006.01) |
| ***G09G 3/34*** | (2006.01) |

(52) U.S. Cl.

CPC ..... *G09G 5/005* (2013.01); *G09G 3/3406* (2013.01); *G09G 5/028* (2013.01); *G09G 2320/0613* (2013.01)

(58) Field of Classification Search

CPC ..... G09G 2320/0613; G09G 5/028; G09G 3/3406; G09G 5/005

See application file for complete search history.

(56) References Cited

U.S. PATENT DOCUMENTS

2013/0314453 A1* 11/2013 Ko ..... G06F 3/04817 345/102

* cited by examiner

*Primary Examiner* — Abbas I Abdulselam

(74) *Attorney, Agent, or Firm* — JCIPRNET

(57) ABSTRACT

A signal processing method of a transparent display is disclosed. The signal processing method includes: receiving an input signal; performing a signal conversion step on the input signal to form a converted signal; after performing the signal conversion step, performing a signal identification step based on the converted signal; generating an image signal and a control signal from the input signal and a signal identification result of the signal identification step; outputting the image signal for light emission adjustment of the transparent display; and outputting the control signal for transparency adjustment of the transparent display, wherein a converted gray scale of a pixel is obtained by multiplying at least two gray scales among a red gray scale, a green gray scale, and a blue gray scale of the pixel by previously set corresponding coefficients and summing the multiplied gray scales.

6 Claims, 11 Drawing Sheets

SIGNAL PROCESSING METHOD OF TRANSPARENT DISPLAY

CROSS-REFERENCE TO RELATED APPLICATION

This application is a continuation application of and claims the priority benefit of U.S. application Ser. No. 17/151,630, filed on Jan. 18, 2021, now pending, which claims the priority benefit of Chinese patent application serial no. 202010078972.8, filed on Feb. 3, 2020. The entirety of each of the above-mentioned patent applications is hereby incorporated by reference herein and made a part of this specification.

BACKGROUND

Technical Field

The disclosure relates to a controlling method of a transparent display, and particularly relates to a signal processing method of a transparent display.

Description of Related Art

A transparent display may allow ambient light of a background to pass through when displaying a main image, and the main image and the background image may be viewed by a user at the same time.

When the main image is actually displayed, if a brightness of the background image is too high, contrast of the main image may be reduced, or characteristic edges of the main image are likely to be blurred. Therefore, the transparency corresponding to the main image needs to be properly controlled to improve the image quality of the transparent display.

SUMMARY

The disclosure provides a signal processing method of a transparent display. The signal processing method includes: receiving an input signal; performing a signal conversion step on the input signal to form a converted signal; after performing the signal conversion step, performing a signal identification step based on the converted signal; generating an image signal and a control signal from the input signal and a signal identification result of the signal identification step; outputting the image signal for light emission adjustment of the transparent display; and outputting the control signal for transparency adjustment of the transparent display, wherein a converted gray scale of a pixel is obtained by multiplying at least two gray scales among a red gray scale, a green gray scale, and a blue gray scale of the pixel by previously set corresponding coefficients and summing the multiplied gray scales.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1A:
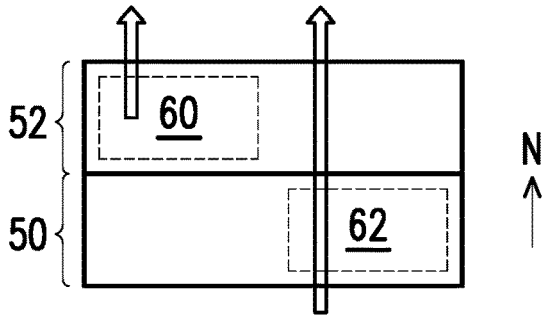
FIG. 1A to FIG. 1C are structural schematic diagrams of a local area of a transparent display according to an embodiment of the disclosure.

In the following description, some embodiments of the disclosure are described with reference to the drawings. In fact, these embodiments may have many different variations, and the disclosure is not limited to the provided embodiments. The same referential numbers in the drawings are used to indicate the same or similar components.

The disclosure may be understood by referring to the following detailed description in collaboration with the accompanying drawings. It should be noted that for reader's easy understanding and simplicity of the drawings, in the multiple drawings of the disclosure, only a part of an electronic device is illustrated, and specific components in the drawings are not necessarily drawn to scale. Moreover, an amount and size of each component in the drawings are only schematic, and are not intended to limit the scope of the disclosure.

Certain terms are used throughout the specification of the disclosure and the appended claims to refer to specific components. Those skilled in the art should understand that electronic device manufacturers may probably use different names to refer to the same components. This specification is not intended to distinguish between components that have the same function but different names. In the following specification and claims, the terms "including", "containing", "having", etc., are open terms, so that they should be interpreted as meaning of "including but not limited to . . . ". Therefore, when the terms "including", "containing", and/or "having" are used in the description of the disclosure, they specify the existence of corresponding features, regions, steps, operations, and/or components, but do not exclude the existence of one or more corresponding features, regions, steps, operations, and/or components.

Directional terminologies mentioned in the specification, such as "top", "bottom", "front", "back", "left", "right", etc., are used with reference to the orientation of the figures being described. Therefore, the used directional terminologies are only illustrative, and are not intended to limit the disclosure. In the figures, the drawings illustrate general characteristics of methods, structures, and/or materials used in specific embodiments. However, these drawings should not be construed as defining or limiting a scope or nature covered by these embodiments. For example, for clarity's sake, a relative size, a thickness and a location of each layer, area and/or structure may be reduced or enlarged.

When a corresponding component, for example, a layer or an area referred to be "on another component", the component may be directly located on the another component, or other components probably exist there between. On the other hand, when a component is referred to be "directly on another component", none other component exits there between. Moreover, when a component is referred to be "on another component", the two components have an up-down relationship in a top view, and this component may be above or below the another component, and the up-down relationship depends on an orientation of the device.

It should be understood that when a component or a layer is referred to as being "connected to" another component or layer, it may be directly connected to the another component or layer, or there is an intervening component or layer there between. When a component is referred to as being "directly connected" to another component or layer, there is no intervening component or layer there between. Moreover, when a component is referred to as being "coupled to another component", the component may be directly connected to the another component, or indirectly connected (for example, electrically connected) to the another component through one or more components.

The terms "about", "equal to", "equivalent" or "identical", "substantially" or "approximately" are generally interpreted as being within a range of plus or minus 20% of a given value, or as being within a range of plus or minus 10%, plus or minus 5%, plus or minus 3%, plus or minus 2%, plus or minus 1%, or plus or minus 0.5% of the given value.

The ordinal numbers used in the specification and claims, such as "first", "second", etc., are used to modify components, and do not imply and represent the component or these components have any previous ordinal numbers, and do not represent a sequence of one component with another, or a sequence in a manufacturing method. The use of these ordinal numbers is only to make a clear distinction between a component with a certain name and another component with the same name. The same terms may not be used in the claims and the specification, and accordingly, a first component in the specification may be a second component in the claims.

The disclosure includes transparency control of a transparent display. The transparency control is implemented according to a control signal generated by analyzing an input image signal through a signal analysis unit. After the transparency corresponding to an image region of a transparent display is appropriately adjusted, a display quality of the whole image, such as contrast, may be effectively enhanced.

Embodiments are provided below for describing the disclosure in detail, but the disclosure is not limited to the provided embodiments, and the provided embodiments may be mutually combined, suitably.

Figure 1B:
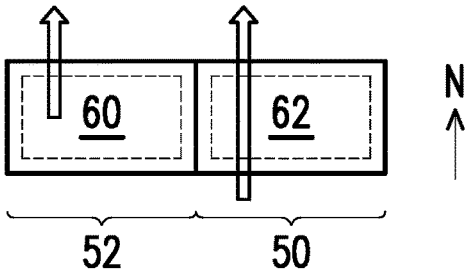
Figure 1C:
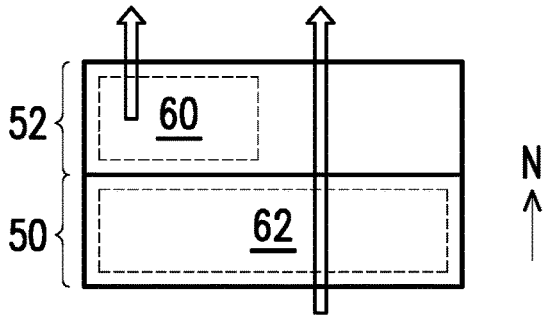

FIG. 1A to FIG. 1C are structural schematic diagrams of a local area of a transparent display according to an embodiment of the disclosure. It should be noted that when a user watches a transparent display, he/she can see a whole image including a main image and a background image, the main image is displayed in the image region of the transparent display, and the background image is seen through the transparent region of the transparent display at the same time. Meanwhile, a transparent display may include a plurality of pixels, and the local area which will be described below may correspond to one pixel or a collection of a plurality of pixels in the image region or the transparent region of the transparent display. Referring to FIG. 1A, in a side-view direction, a light-emitting section 60 and a transparent section 62 included in a local area of the transparent display are respectively disposed in, for example, different display units 52 and 50, and arrows represent an emission path and a passage path of light. According to FIG. 1A, it is known that the display unit 50 and the display unit 52 are overlapped in a normal direction N of the display unit 50, but the transparent section 62 is not overlapped with the light-emitting section 60. The light-emitting section 60 may emit light according to a color corresponding to the position of the local area and the gray scale information in an image signal. A transparency of the transparent section 62 of the local area corresponding to the main image may be controlled to adjust the light passing through the transparent section 62 to match the main image displayed by the light-emitting section 60 of the same local area. In the transparent display of the disclosure, one pixel may include, for example, three sub-pixels and at least one transparent section, but the disclosure is not limited thereto. The three sub-pixels may correspond to three light-emitting sections of different color lights. In some embodiments, each sub-pixel may correspond to a transparent section, and in some other embodiments of the disclosure, a plurality of sub-pixels may correspond to one transparent section. The configuration method of the transparent section is not limited by the disclosure.

Moreover, the light-emitting section 60 may include an organic light-emitting diode (OLED), an inorganic light-emitting diode (LED), a mini LED, a micro LED, quantum dots (QD), a quantum dot LED (QLED/QDLED), fluorescence materials, phosphor materials, other proper materials or a combination of the above materials, but the disclosure is not limited thereto. The transparent section 62 of the disclosure may include materials such as liquid crystal, electrophoretic ink, etc., but the disclosure is not limited thereto.

Referring to FIG. 1B, in other embodiments, the display unit 52 where the light-emitting section 60 is located and the display unit 50 where the transparent section 62 is located may also be integrated in a same panel without overlapping. Referring to FIG. 1C, in another embodiment, the display unit 50 may overlap the display unit 52 in the normal direction N of the display unit 50, and the transparent section 62 may partially overlap the light-emitting section 60.

The configurations of the light-emitting section 60 and the transparent section 62 shown in FIG. 1A to FIG. 1C are only illustrative, and in some embodiments, the transparent display may have a plurality of light-emitting sections 60 and the transparent sections 62, and the light-emitting sections 60 and the transparent sections 62 of the transparent display may have different configurations or structures.

The disclosure proposes to generate a control signal that controls the transparency of the transparent section 62 based on analysis of the input image signal. The transparency of the transparent section 62 corresponding to a current displayed image may be appropriately controlled to improve the image quality of the transparent display.

Figure 2:
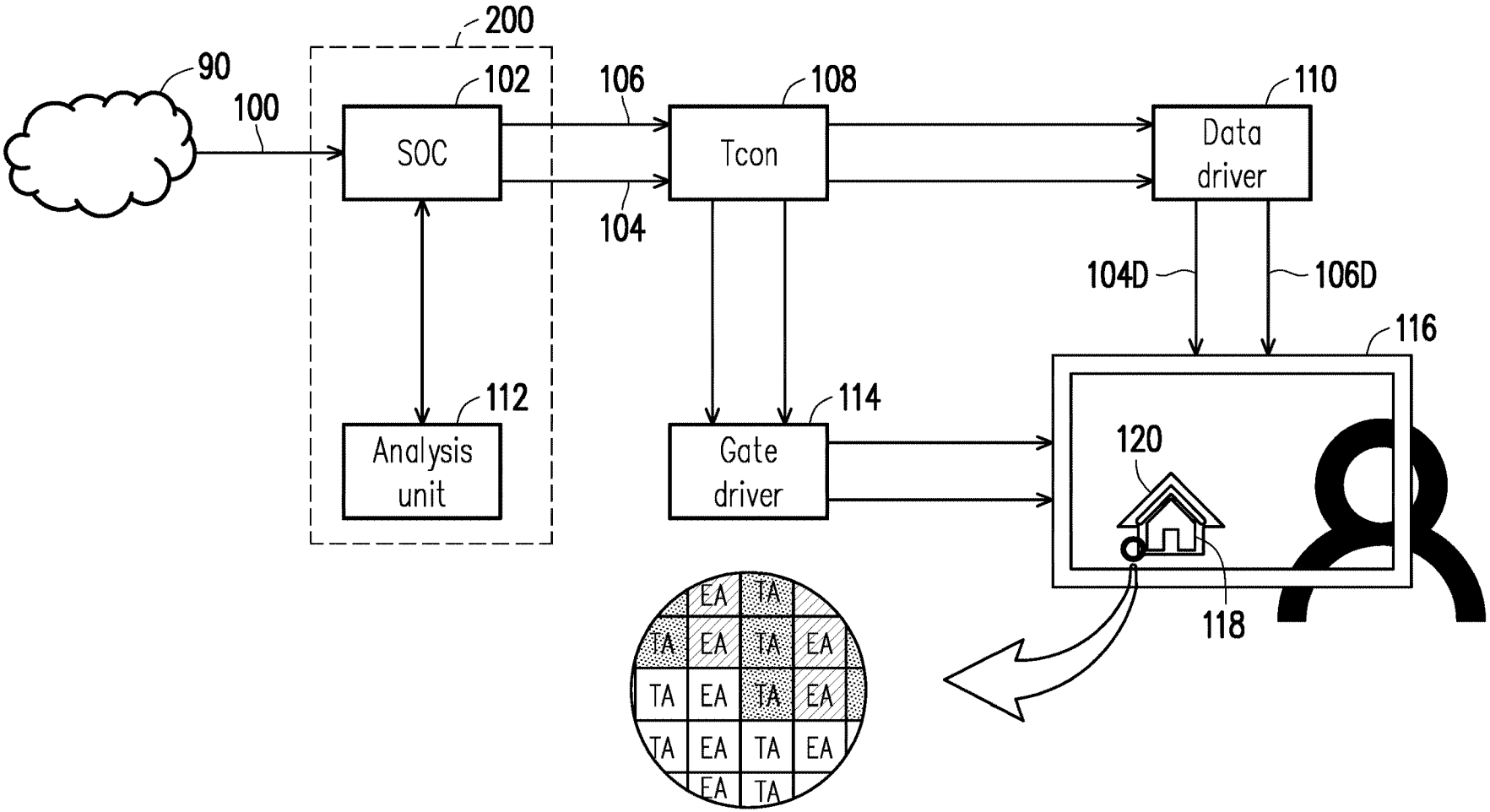
FIG. 2 is a schematic diagram of a system structure of a transparent display according to an embodiment of the disclosure.

FIG. 2 is a schematic diagram of a system structure of a transparent display according to an embodiment of the disclosure. Referring to FIG. 2, a system on chip (SOC) 102 of the transparent display receives an input signal 100 from an image signal source 90 such as a storage device (for example, a hard drive), an external storage medium (for example, DVD) in a terminal device (for example, a computer) or in a cloud end (for example, a network). In an embodiment, the SOC 102 and an analysis unit 112 may be combined into a system processing unit 200 to perform an analysis of the input signal 100, for example, including an analysis of image colors and gray scales, but the disclosure is not limited thereto. After the input signal 100 is processed, the SOC 102 generates an image signal 106 and a control signal 104. The image signal 106 and the control signal 104 control a data driver 110 and a gate driver 114 through a timing controller (T-con) 108. Outputs 104D and 106D of the data driver 110 and outputs of the gate driver 114 may control a transparent display panel 116 to display a main image 118. Transparent sections of the transparent display panel 116 allow the light from the background to pass through. However, at least a part of transparent sections corresponding to the main image 118 needs to be adjusted appropriately, and an interference of the light from the background is reduced when the whole image is displayed.

Referring to FIG. 2, taking an edge area of the main image 118 as an example, each light-emitting section is represented by EA, and each transparent section is represented by TA. The main image 118 is shown by adjusting the light emission of each light-emitting section according to the image signal 106 (for example, the light emission sections corresponding to the background image may not emit light, and the light emission sections corresponding to the main image 118 emit light according to the corresponding gray scales). Some of the transparent sections TA (such as the transparent sections TA without perspective shadows) that are not involved in the main image 118 may be adjusted to a high transparency according to the control signal 104, but the transparency of other transparent sections TA (such as the transparent sections TA with the perspective shadows) that are involved in the main image 118 may be adjusted to a low transparency according to the control signal 104.

Figure 3:
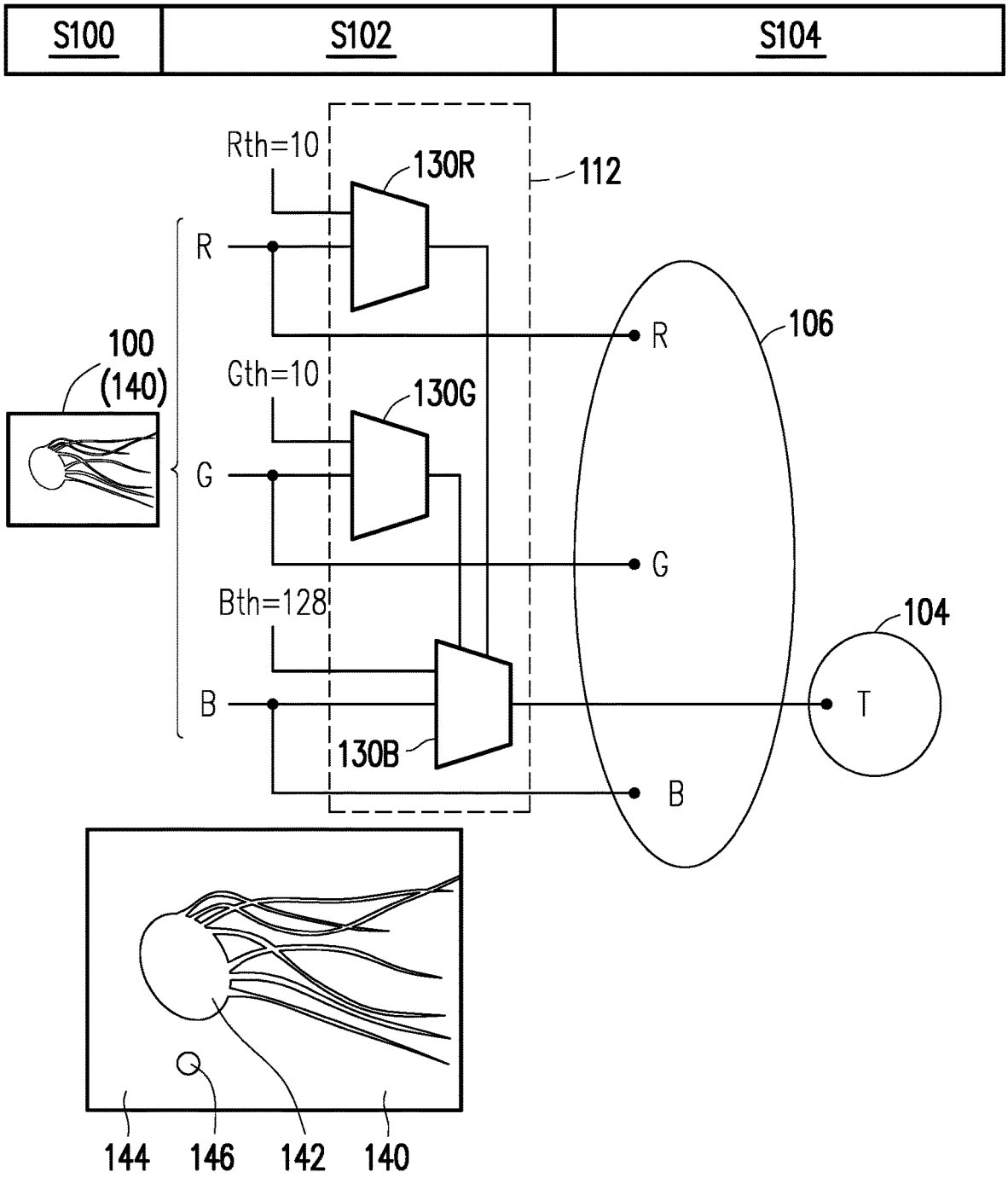
FIG. 3 is a schematic diagram of a circuit for gray scale signal identification according to an embodiment of the disclosure.

FIG. 3 is a schematic diagram of a circuit for gray scale signal identification according to an embodiment of the disclosure. Referring to FIG. 2 and FIG. 3, the signal processing of the system processing unit 200 of FIG. 2 may have three steps including a receiving step S100, a generating step S102, and an output step S104.

In the receiving step S100, the input signal 100 of a whole image is received, and the input signal 100 corresponds to image content 140. Taking an image of jellyfish swimming shown in FIG. 3 as an example, seawater serving as a background image 144 presents a blue color in the image content 140, and a jellyfish serving as a main image 142 is mainly brown.

The analysis unit 112 may include a selector 130R, a selector 130G, and a selector 130B respectively corresponding to a red color, a green color, and a blue color. In the embodiment, the selector 130R, the selector 130G and the selector 130B may be implemented by hardware or firmware. By using the analysis unit 112 to analyze the input signal 100, in the image content 140 corresponding to the input signal 100, if a detected area is determined to belong to the background image 144, the corresponding transparent sections (to be more specific, the transparency of a plurality of transparent sections distributed in the area corresponding to the background image 144) may be set to a high transparency, and if the detected area is determined to not belong to the background image 144, the corresponding transparent sections (to be more specific, the transparency of a plurality of transparent sections distributed in the area corresponding to the main image 142) may be set to a low transparency, but the disclosure is not limited thereto.

In the embodiment shown in FIG. 3, taking a detected area 146 in the background image 144 as an example, a red gray scale R, a green gray scale G, and a blue gray scale B corresponding to the detected area 146 in the input signal 100 may be, for example, respectively R=5, G=5 and B=150. By comparing the above gray scales with red, green, and blue gray scale thresholds (for example, Rth=10, Gth=10, and Bth=128) provided by a database, it is identified that the local area is biased to the blue color. At this moment, the red, green and blue gray scales of the input signal 100 corresponding to the detected area 146 may be directly output as the image signal 106. In the embodiment, the red gray scale R and the green gray scale G in the image signal 106 are respectively smaller than the red and green gray scale thresholds Rth and Gth, and the blue gray scale B is greater than the blue gray scale threshold Bth. Moreover, a determination condition for determining whether the output control signal 104 corresponds to the area of the background may be, for example, a following equation (1):

$$R < Rth;\ G < Gth;\ B > Bth \tag{1}$$

Under such determination, when the input signal 100 is complied with the equation (1) and it is determined that the local area belongs to the background image 144, the corresponding transparent sections may be set to the high transparency (for example, the transparency T=Tmax), and the corresponding control signal 104 is output. When a gray scale of each color light of a local area in the input signal 100 is not complied with the equation (1), the transparent sections corresponding to the local area is set to the low transparency, and other corresponding control signal 104 is output.

It should be noted that in the embodiment of FIG. 3, the detection of the blue background of the seawater is taken as an example for description, but the disclosure is not limited thereto. The data provided by the database is based on various possible background conditions after statistics. There are different ways to identify different backgrounds. The analysis unit 112 of the disclosure analyzes the input signal 100 to identify areas that may probably belong to the background image 144 or the main image 142, and generates the control signal 104 to adjust the transparency of the corresponding transparent sections.

Figure 4:
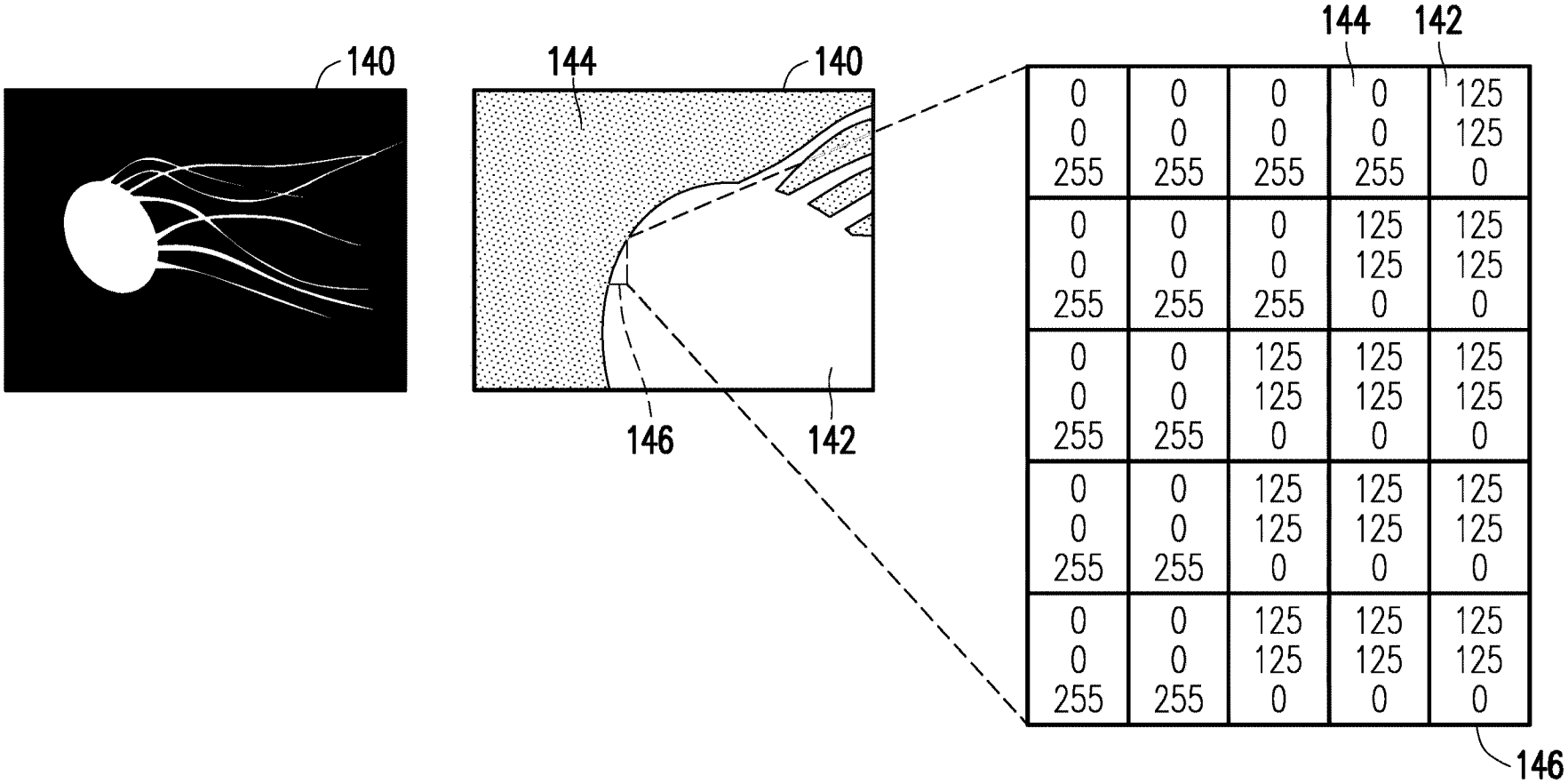
FIG. 4 is a schematic diagram of pixel gray scales of an input signal according to an embodiment of the disclosure.

FIG. 4 is a schematic diagram of the pixel gray scales of the input signal according to an embodiment of the disclosure. Referring to FIG. 4, three values of each pixel in the figure are respectively red, green and blue gray scales from top to bottom. Taking the detected area 146 at a boundary of the main image (the jellyfish) 142 and the background image (the seawater) 144 in the image content 140 as an example, the gray scale of a blue portion in a pixel belonging to the background image 144 is 255 (the higher the gray scale is, the higher a corresponding brightness is), and the blue gray scale B of a pixel (i.e., the gray scale of the blue sub-pixel in a pixel) belonging to the main image 142 is 0, and the red gray scale R (i.e., the gray scale of the red sub-pixel in a pixel) and the green gray scale G (i.e., the gray scale of the green sub-pixel in a pixel) thereof may be, for example, respectively 125.

Figure 5:
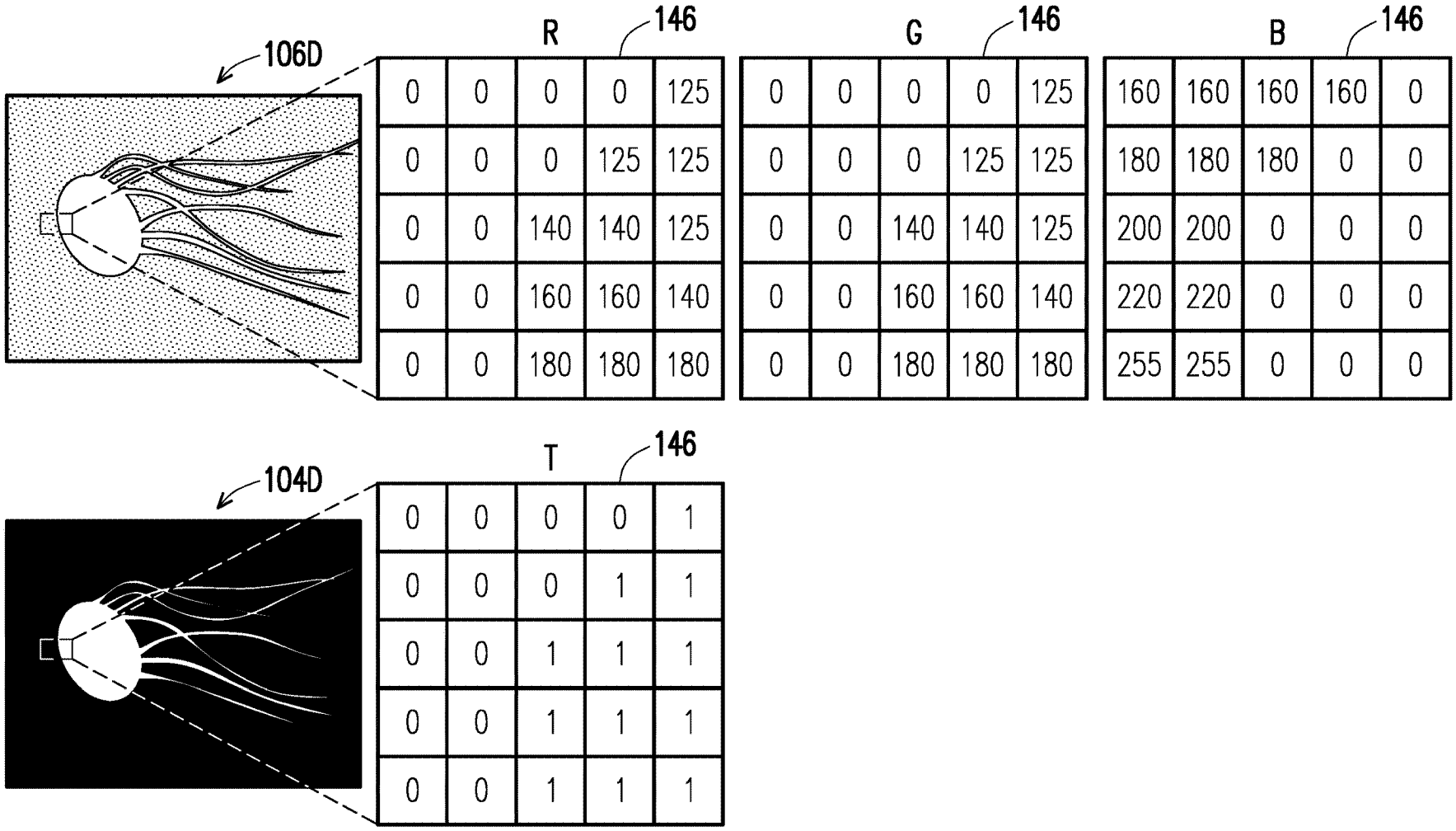
FIG. 5 is a schematic diagram of pixel gray scales of an input signal and judgment values of transparency according to an embodiment of the disclosure.

FIG. 5 is a schematic diagram of pixel gray scales of the input signal and judgment values of transparency according to an embodiment of the disclosure. Referring to FIG. 2 and FIG. 5, in an embodiment, the input signal 100 is processed to obtain the image signal 106 and the control signal 104. Finally, in the outputs 104D and 106D of the data driver 110, the output 106D corresponding to the image signal 106 maintains the original red, green and blue gray scales of the image, and the output 104D corresponding to the control signal 104 is used to binarize the transparency T, a binarized judgment value "0" indicates that the transparent section is at the high transparency T, for example, the transparency T=Tmax to correspond to the background, and a binarized judgment value "1" indicates that the transparent section is at the low transparency to correspond to the main image. It should be noted that in the disclosure, the binarization of the transparency T into two judgment values (0 and 1) is only an example, and different transparencies T may correspond to more judgment values according to actual needs.

In some embodiments, signal processing of the system processing unit 200 is implemented by a signal conversion unit (not shown) and a signal identification unit (not shown). In these embodiments, a function of the signal identification unit is similar to that of the analysis unit 112 in FIG. 2, by which color analysis is performed on three sub-pixels of one pixel to identify whether the pixel belongs to the background. However, in the embodiment, before the function of the signal identification unit is executed, the signal conversion unit is firstly used to convert the gray scale values of the image to form another image. Thereafter, the identification is performed based on the converted image, and then the corresponding control signal 104 is generated according to an identification result.

Figure 6:
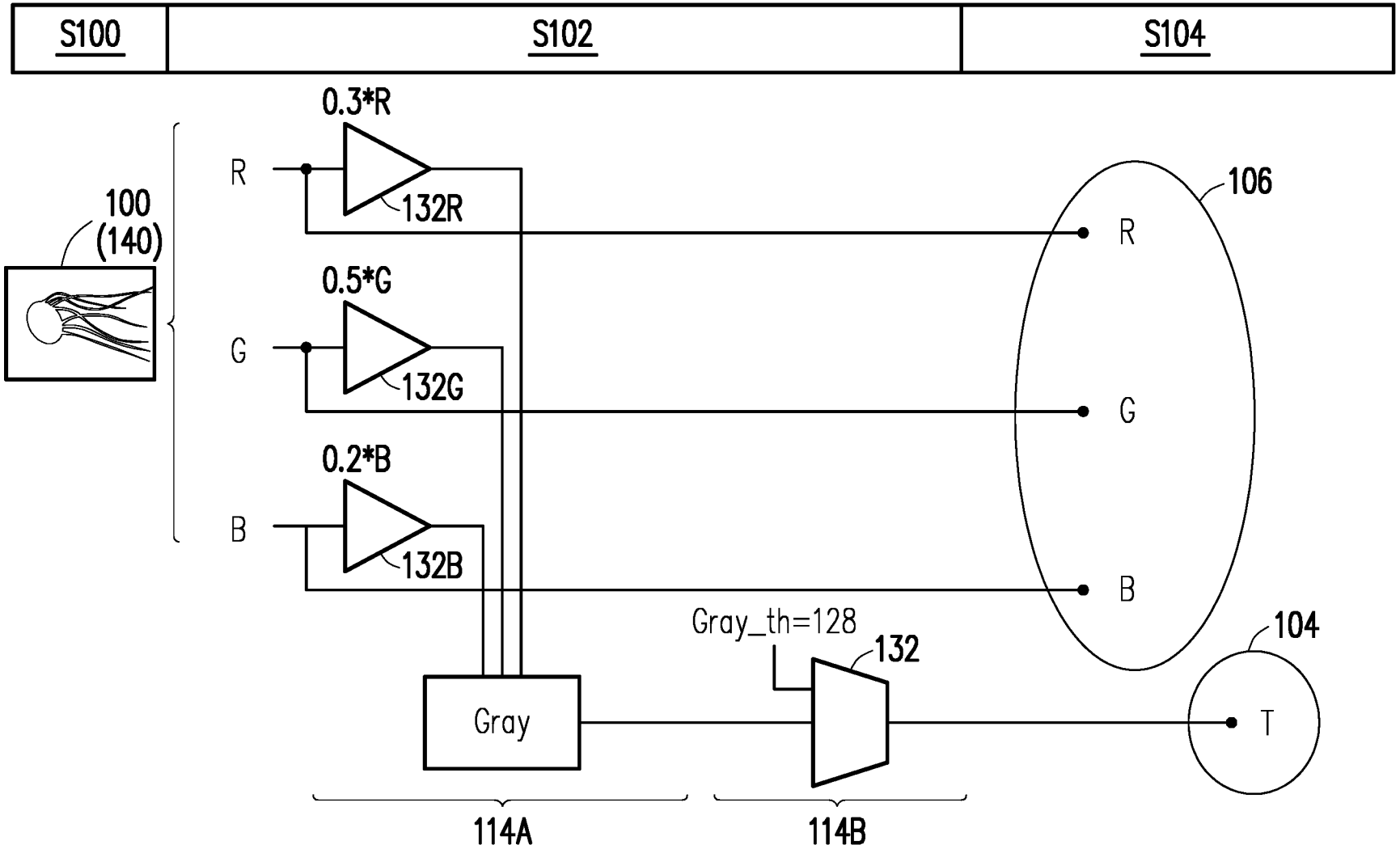
FIG. 6 is a schematic diagram of a transparent display combined with a circuit of gray scale signal conversion and signal identification according to an embodiment of the disclosure.

FIG. 6 is a schematic diagram of a transparent display combined with a circuit of gray scale signal conversion and signal identification according to an embodiment of the disclosure. Referring to FIG. 6, taking the identification of the blue background image of the image content 140 in FIG. 3 as an example, a mechanism of a signal conversion unit 114A and a signal identification unit 114B is described as follows.

In the receiving step S100, the input signal 100 corresponding to the image content 140 is received. In the image content 140, it is required to identify whether a position of a pixel belongs to the background image, and to determine the transparency T of the transparent section corresponding to each pixel according to the identification result. For example, in the embodiment, if the red gray scale R, the green gray scale G, and the blue gray scale B of a pixel are, for example, respectively R=5, G=5, and B=150, the pixel may be determined to belong to the background image such as the seawater to present the blue color. In the generating step S102, the signal conversion unit 114A sets a converter 132R, a converter 132G, and a converter 132B respectively corresponding to the red color, the green color, and the blue color, and respectively multiplies the received red gray scale R, the green gray scale G and the blue gray scale B by previously set coefficients 0.3, 0.5, and 0.2 to obtain a converted gray scale of the pixel, which is represented by Gray. It should be noted that the coefficients of the embodiment are only exemplary, and the disclosure is not limited thereto. In fact, the coefficients of the converters 132R, 132G, and 132B may be set according to relevant statistical data of human vision (such as public research data), or may be changed with different manufacturers or market, etc. In the embodiment, calculation of the converted gray scale Gray of the pixel may be performed based on, for example, a following equation (2):

$$\text{Gray} = 0.3 * R + 0.5 * G + 0.2 * B \tag{2}$$

After inputting R=5, G=5, and B=150, the converted gray scale of the pixel Gray=34 is obtained. The converted gray scale Gray is input to the signal identification unit 114B (for example, the selector 132). A threshold of the selector 132 may be, for example, Gray_th=128. A determination condition for determining whether the output control signal 104 corresponds to the background image may be, for example, a following equation (3):

$$\text{Gray} < \text{Gray_th},\ T = T\text{max} \tag{3}$$

The control signal 104 may correspond to the transparency T. For example, under the condition of Gray<Gray_th, it may be determined that the detected pixel tends to the blue color, and accordingly, the pixel is identified as belonging to the background image. Therefore, the control signal 104 may correspond to situation of a high transparency, such as the transparency T=Tmax.

In the output step S104, the input signal 100 includes the original image gray scales and is directly output as the image signal 106. The control signal 104 is also output at the same time, and is subsequently used for transparency adjustment of the transparent sections. It should be noted that although the image signal 106 is the same as the input signal 100 in the embodiment, in some embodiments, there may be a conversion mechanism between the input signal 100 and the image signal 106, and the input signal 100 and the image signal 106 are different.

Figure 7:
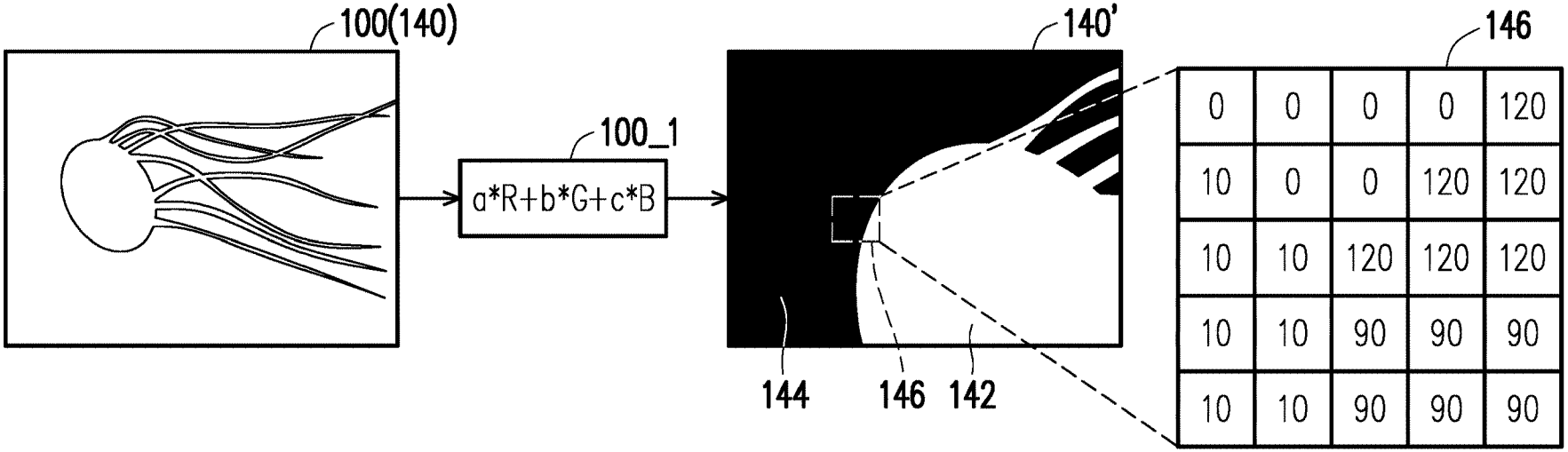
FIG. 7 is a schematic diagram of a gray scale signal conversion mechanism of a transparent display according to an embodiment of the disclosure.

FIG. 7 is a schematic diagram of a gray scale signal conversion mechanism of the transparent display according to an embodiment of the disclosure. Referring to FIG. 6 and FIG. 7, in view of a gray scale signal conversion effect, the image of the input signal 100 is converted by a gray scale signal conversion unit 100_1 to obtain converted image content 140', and to present a distribution of the converted gray scale Gray corresponding to the image content 140. In the image content 140', the blue color belonging to the background image 144 is easily presented to distinguish with the actual main image 142 (the jellyfish), and the signal identification unit 114B may work more effectively.

It should be noted that the previous conversion mechanism is gray scaling, but the disclosure is not limited to a specific conversion mechanism. For example, a binarization conversion mechanism or an edge enhancement conversion mechanism may also be adopted. According to the binarization conversion mechanism, the image content 140' may be distinguished into two gray scale values, for example, two values of 0 (the darkest) and 255 (the brightest) by using a threshold M according to the known converted gray scale Gray, the binarization conversion mechanism is adopted to present an image with only black and white. The edge enhancement conversion mechanism may be implemented by adopting commonly known methods, such as a shift-and-difference method, a gradient method or a Laplacian method, etc., but the disclosure is not limited thereto.

Figure 8:
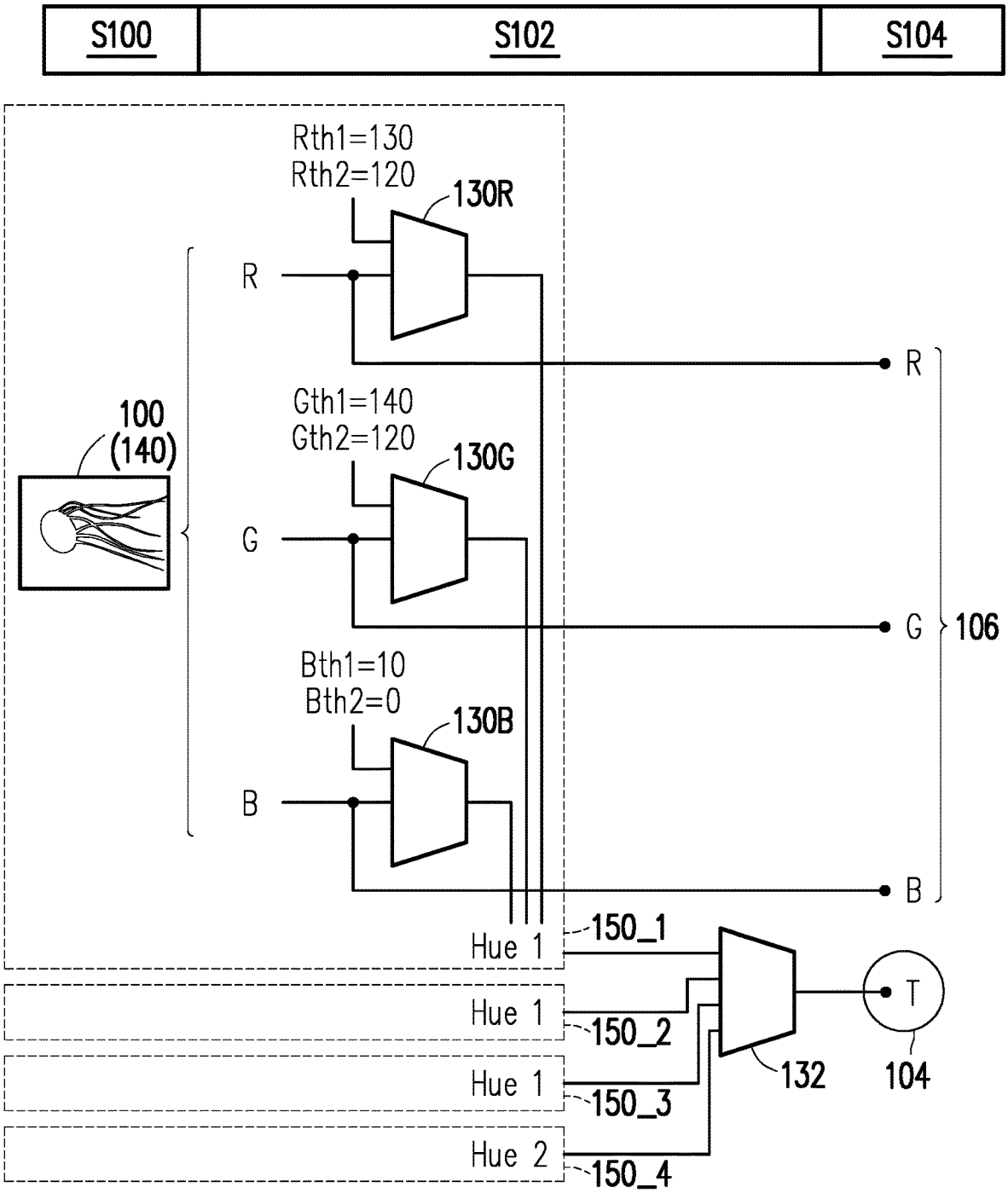
FIG. 8 is a schematic diagram of a circuit that performs identification through hues according to an embodiment of the disclosure.

FIG. 8 is a schematic diagram of a processing circuit that performs identification based on hues according to an embodiment of the disclosure. Referring to FIG. 8, the signal processing method may perform analysis based on hues. Regarding the types of hues, a hue may be determined according to ranges of the red, green and blue gray scales. In other words, when a display device includes a first pixel and a second pixel, and a red gray scale R1 of the first pixel and a red gray scale R2 of the second pixel are within a same range of red gray scale, a green gray scale G1 of the first pixel and a green gray scale G2 of the second pixel are within a same range of green gray scale, and a blue gray scale B1 of the first pixel and a blue gray scale B2 of the second pixel are within a same range of blue gray scale, the first pixel and the second pixel may be defined to belong to a same hue. By dividing the red, green, and blue gray scales in the image content into a plurality of ranges, a plurality of hues may be defined. It should be noted that the division method of the hues may be changed by factors such as different manufacturers or corresponding markets, etc. Taking a hue 1 in the embodiment as an example, a range of the corresponding red gray scale R is, for example, between 120 and 130. A range of the green gray scale G is, for example, between 120 and 140. A range of the blue gray scale B is, for example, between 0 and 10. In this way, the hues of a plurality of image areas 150_1, 150_2, 150_3, and 150_4 may be distinguished according to the preset gray scale ranges, and the types of the hues are input to the selector 132 for performing identification.

When the image content is identified, if an area belonging to the same hue is smaller, the area may probably correspond to the main image itself, and the control signal 104 corresponding to the area may correspond to the low transparency. In contrast, when an area belonging to the same hue becomes larger, the area may probably correspond to the background image, and the control signal 104 corresponding to the area may correspond to the high transparency. For example, in the embodiment shown in FIG. 10, multiple consecutive image areas 150_1, 150_2, and 150_3 have the same hue, and these areas may be probably determined as the background image and correspond to the high transparency, while only one image area 150_4 has another hue, and the image area 150_4 may be probably determined as the main image to correspond to the low transparency. It should be noted that the embodiment is only an example, and the definition of the hues and the analysis mechanism of the hues are not limited by the disclosure.

Figure 9:
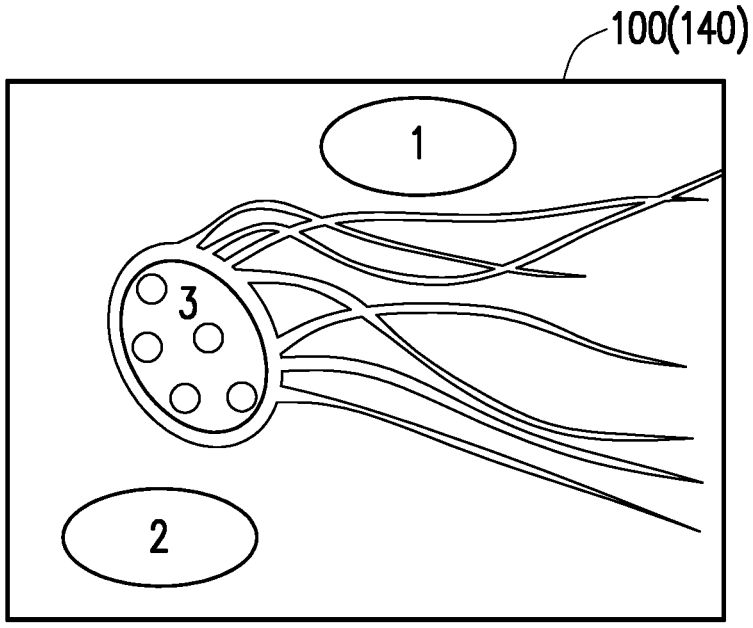
FIG. 9 is a schematic diagram of an effect of identification performed through hues according to an embodiment of the disclosure.

FIG. 9 is a schematic diagram of an effect of identification performed through the hues according to an embodiment of the disclosure. Referring to FIG. 9, regarding the input image content 140, a pixel range distribution corresponding to each hue in the image content may be analyzed, or an amount of hues (a hue density) contained within a certain range may be analyzed to determine the main image and the background image. For example, in a range 1 or a range 2 of the image content 140, there are less types of hues, and the two ranges probably belong to the background image. There are more types of hues in a range 3, that is, the hue density is higher, and the range 3 probably belongs to the main image itself. It should be noted that regarding the background image of different locations, such as the range 1 and the range 2 of FIG. 9, the hues thereof may be probably different.

Figure 10:
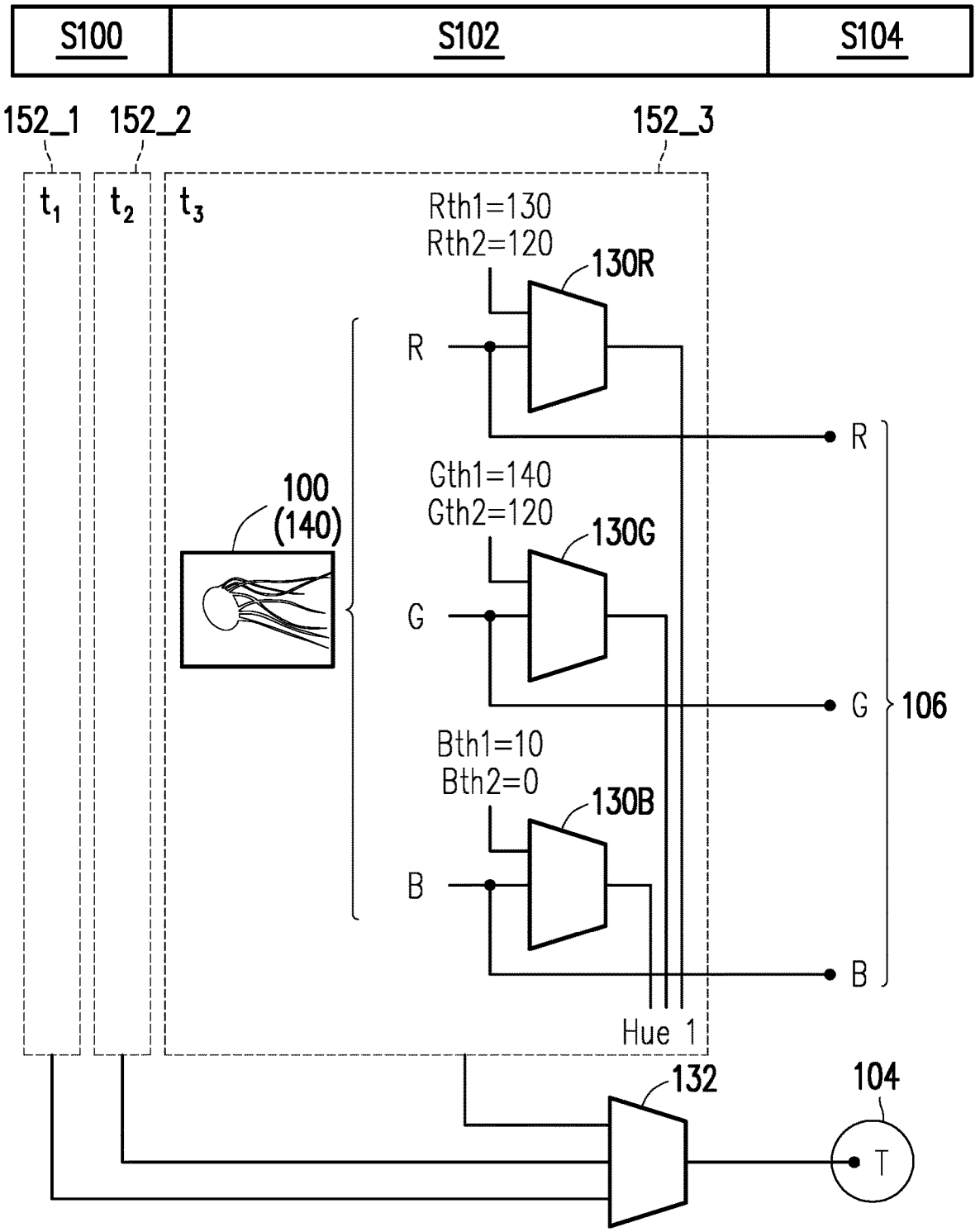
FIG. 10 is a schematic diagram of a circuit that performs identification according to time variation according to an embodiment of the disclosure.

FIG. 10 is a schematic diagram of a circuit that performs identification according to time variation according to an embodiment of the disclosure. Referring to FIG. 10, when the input signal corresponds to a series of dynamic images, the identification mechanism may also perform based on the hue variation over time. For example, a time point of an image 152_1 is $t_1$, a time point of an image 152_2 is $t_2$, and a time point of an image 152_3 is $t_3$. It is generally known that, since the main image (such as the jellyfish in the embodiment) may move, but the background image generally changes slowly, hue variation of the pixels corresponding to the main image is more obvious. Therefore, by detecting the hue variation of a pixel over time in multiple consecutive images, for example, three consecutive images corresponding to the time points $t_1$ to $t_3$, the areas belonging to the background image or the main image in the image may be determined. For example, regarding a detected pixel, if the hue variation in the three images of three consecutive time points is small, the detected pixel may be determined to belong to the background image, and may be set to the high transparency. Conversely, regarding a pixel with a larger hue variation, the pixel is determined to belong to the main image, and may be set to the low transparency. It should be noted that an amount of images used for determination in the disclosure is not limited to three, and the determined image is not necessarily the last one of several consecutive images. In some embodiments, the determined image may be the first one or the middle one in the several consecutive images.

Figure 11:
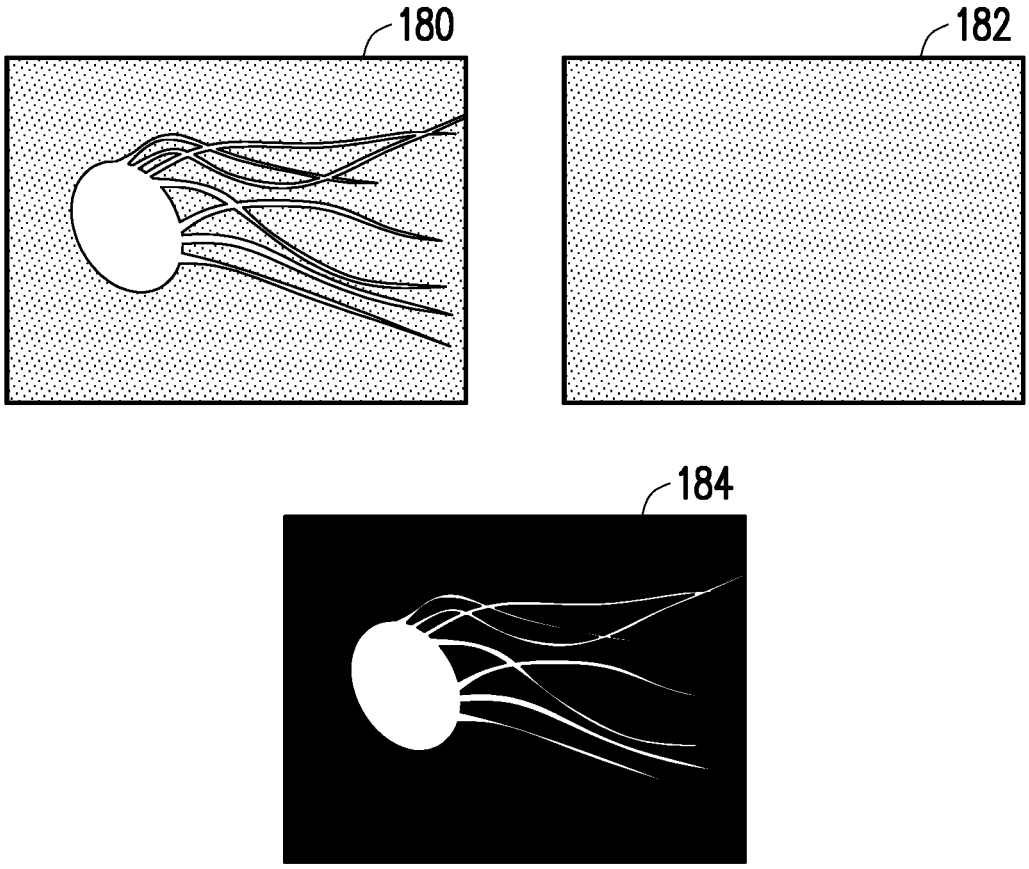
FIG. 11 is a schematic diagram of another identification mechanism according to an embodiment of the disclosure.

FIG. 11 is a schematic diagram of another identification mechanism according to an embodiment of the disclosure. Referring to FIG. 11, in the identification mechanism, regarding a detected area, points of difference between two images may be compared through the image 180 and the image 182 displayed at different time points. Difference values greater than or smaller than a difference threshold are used to perform image determination. In such identification mechanism, the main image and the background image exist at the time point corresponding to the image 180, and the main image disappears at the time point corresponding to the image 182 to leave only the background image. Therefore, it may be determined that the difference between the image 180 and the image 182 lies in the range of the main image, and the transparency of the main image may be adjusted to the low transparency, and the transparency of the background image may be adjusted to the high transparency.

Therefore, if the method of FIG. 11 is adopted, the image 180 and the image 182 may be subtracted to obtain a difference image 184. In this way, the gray scale of the background image may be effectively removed to obtain a relatively pure main image, and then signal identification is performed according to the signal converted image, which helps to identify areas that belong to the background image for setting to the high transparency.

As described above, for a transparent display, after receiving the input signal, it may roughly identify the region belonging to the background image according to a preset identification mechanism. The transparent sections of the pixels corresponding to the background image may have a higher transparency to allow more ambient light to pass through the transparent sections. The transparent sections of the pixels corresponding to the main image may have a lower transparency, which reduces the influence of the ambient light, and improves the contrast of the image.

Although the embodiments and advantages of the embodiments of the disclosure have been disclosed as above, it should be understood that anyone with ordinary knowledge in the technical field may make combinations, changes, substitutions, and decorations without departing from the spirit and scope of the disclosure. Moreover, a protection scope of the disclosure is not limited to the devices, methods, and steps of the specific embodiments described in the specification, and anyone with ordinary knowledge in the technical field may understand the present or future developed devices, methods and steps from the content disclosed in the disclosure, which may all be used according to the disclosure as long as the substantially same functions may be implemented or the substantially same results may be obtained in the embodiments described herein. Therefore, the protection scope of the disclosure includes the above devices, methods, and steps. In addition, each claim constitutes an individual embodiment, and the protection scope of the disclosure also includes a combination of each claim and the embodiment. The protection scope of the disclosure is defined by the appended claims.

What is claimed is:

1. A signal processing method for a transparent display, comprising:

receiving an input signal;

performing a signal conversion step on the input signal to form a converted signal;

after performing the signal conversion step, performing a signal identification step based on the converted signal;

generating an image signal and a control signal from the input signal and a signal identification result of the signal identification step;

outputting the image signal for light emission adjustment of the transparent display; and outputting the control signal for transparency adjustment of the transparent display, wherein a converted gray scale of a pixel is obtained by multiplying at least two gray scales among a red gray scale, a green gray scale, and a blue gray scale of the pixel by previously set corresponding coefficients and summing the multiplied gray scales.

2. The signal processing method of claim 1, wherein the image signal and the control signal are generated by performing the signal identification step on the input signal.

3. The signal processing method of claim 1, wherein the signal identification step is performed by comparing a gray scale of the input signal with a predetermined gray scale.

4. The signal processing method of claim 1, wherein the identification step is performed to identify whether a position of a pixel belongs to a background image.

5. The signal processing method of claim 1, wherein the identification step is performed by comparing two images displayed at different time.

6. The signal processing method of claim 1, wherein the image signal and the control signal are output at a same time.

* * * * *